US007130561B2

(12) United States Patent
Iikura et al.

(10) Patent No.: US 7,130,561 B2
(45) Date of Patent: Oct. 31, 2006

(54) IMAGE FORMING DEVICE

(75) Inventors: Kazuaki Iikura, Kashiwazaki (JP); Masaya Okamoto, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/857,004

(22) Filed: Jun. 1, 2004

(65) Prior Publication Data

US 2005/0084285 A1 Apr. 21, 2005

(30) Foreign Application Priority Data

Oct. 16, 2003 (JP) ..... 2003-356175

(51) Int. Cl.
*G03G 21/16* (2006.01)
*G03G 15/08* (2006.01)

(52) U.S. Cl. ..... 399/111; 399/121

(58) Field of Classification Search ..... 399/110–114, 399/124–125, 227, 121, 107, 116
See application file for complete search history.

(56) References Cited

U.S. PATENT DOCUMENTS 5,587,769 A * 12/1996 Sawada et al. ..... 399/113
5,887,228 A * 3/1999 Motohashi et al. ..... 399/111
6,535,705 B1 * 3/2003 Asakura et al. ..... 399/119

FOREIGN PATENT DOCUMENTS

| | | |
|---|---|---|
| JP | 2000-227688 | 8/2000 |
| JP | 2001-83766 | 3/2001 |
| JP | 3295416 B2 | 4/2002 |
| JP | 2003-50532 | 2/2003 |

* cited by examiner

*Primary Examiner*—Sandra L. Brase
(74) *Attorney, Agent, or Firm*—Morgan, Lewis & Bockius LLP

(57) ABSTRACT

An image forming device includes: an image carrier that carries an image; a development unit that develops, with toners, a latent image written on the image carrier; an intermediate transfer member to which the toner images formed on the image carrier by the development unit are primarily transferred; and a fixing unit that fixes, to paper, the toner images secondarily transferred from the intermediate transfer member. The image carrier and the intermediate transfer member are unitized to configure an image forming unit, and the image forming unit is disposed in a space sandwiched between the development unit and the fixing unit. The image forming unit further includes a loading/unloading allowing unit that allows the loading/unloading of the image forming unit.

16 Claims, 9 Drawing Sheets

IMAGE FORMING DEVICE

BACKGROUND OF THE INVENTION

1. Field of the Invention

The present invention relates to an image forming device such as a printer or a fax machine.

2. Description of the Related Art

An image forming device that forms a color image due to the rotation of a rotary development unit including development units of the four colors of yellow, magenta, cyan and black is known.

In this type of image forming device, loading/unloading an image forming unit including a photosensitive body and an intermediate transfer belt, so that the photosensitive body abuts against the development units at a development position, is publicly known (e.g., see Japanese Patent No. 3295416 and JP-A-2000-227688, JP-A-2001-83766 and JP-A-2003-50532).

However, sometimes the image forming device cannot be miniaturized because the unitized photosensitive body and intermediate transfer belt are disposed in line in a substantially horizontal direction with respect to the development units.

SUMMARY OF THE INVENTION

The present invention has been made in view of the above circumstances and provides an image forming device that is miniaturized and facilitates the loading/unloading of an image carrier and an intermediate transfer member.

According to an aspect of the present invention, an image forming device includes: an image carrier; a development unit that develops, with toners, a latent image written on the image carrier; an intermediate transfer member to which the toner images formed on the image carrier by the development unit are primarily transferred; and a fixing unit that fixes, to paper, the toner images secondarily transferred from the intermediate transfer member, wherein the image carrier and the intermediate transfer member are unitized to configure an image forming unit, with the image forming unit being disposed in a space sandwiched between the development unit and the fixing unit, and the image forming unit further includes a loading/unloading allowing unit that allows the loading/unloading of the image forming unit. Thus, the image forming unit and the development unit can be disposed in a vertical direction, and the image forming device can be miniaturized in a horizontal direction.

According to another aspect of the present invention, an image forming device includes: an image carrier; a rotary development unit that develops, with toners, a latent image written on the image carrier; and an intermediate transfer member to which the toner images formed on the image carrier by the development unit are primarily transferred, wherein the image carrier and the intermediate transfer member are unitized to configure an image forming unit, and the image forming unit includes a loading/unloading allowing unit that allows the image forming unit to be loaded and unloaded in a substantially tangential direction of the rotary development unit. Thus, when the image forming unit is loaded and unloaded, operating space necessary in a normal line direction of the rotary development unit can be reduced, and the image forming device can be miniaturized.

Thus, the following advantages can be obtained by the above aspects of the present invention.

Even in a case where the direction in which the development rolls are pressed is different from the normal line direction of the rotary development unit, the image forming unit can be prevented from moving in the normal line direction of the rotary development unit, and loading/unloading and positioning of the image forming unit can be facilitated.

The image forming unit can be reliably guided in a substantially tangential direction of the rotary development unit, operating space that is necessary when loading and unloading the image forming unit can be reduced, and the image forming device can be miniaturized.

The image forming unit and the rotary development unit are separated without causing mutual damage, operating space that is necessary when loading and unloading the image forming unit can be reduced, and the image forming device can be miniaturized.

The loading/unloading of the image forming unit can be facilitated because the image forming unit can be loaded and unloaded by opening and closing the open/close cover.

The image carrier cleaner and the intermediate transfer member cleaner can be easily loaded and unloaded, and the maintenance of both can be improved.

According to yet another aspect of the present invention, an image forming device includes: an image carrier; a development unit that develops, with toners, a latent image written on the image carrier; an intermediate transfer member to which the toner images formed on the image carrier by the development unit are primarily transferred; and a fixing unit that fixes, to paper, the toner images secondarily transferred from the intermediate transfer member, wherein the image carrier and the intermediate transfer member are unitized to configure an image forming unit, and the image forming unit is loaded in and unloaded from the image forming device through a space between the fixing unit and the development unit.

According to the present invention, the loading/unloading of an image carrier and an intermediate transfer member is facilitated, and an image forming device can be miniaturized.

BRIEF DESCRIPTION OF THE DRAWINGS

Preferred embodiments of the present invention will be described in detail based on the following figures, wherein.

DETAILED DESCRIPTION OF THE INVENTION

Next, a first embodiment of the invention will be described on the basis of the drawings.

Figure 1:
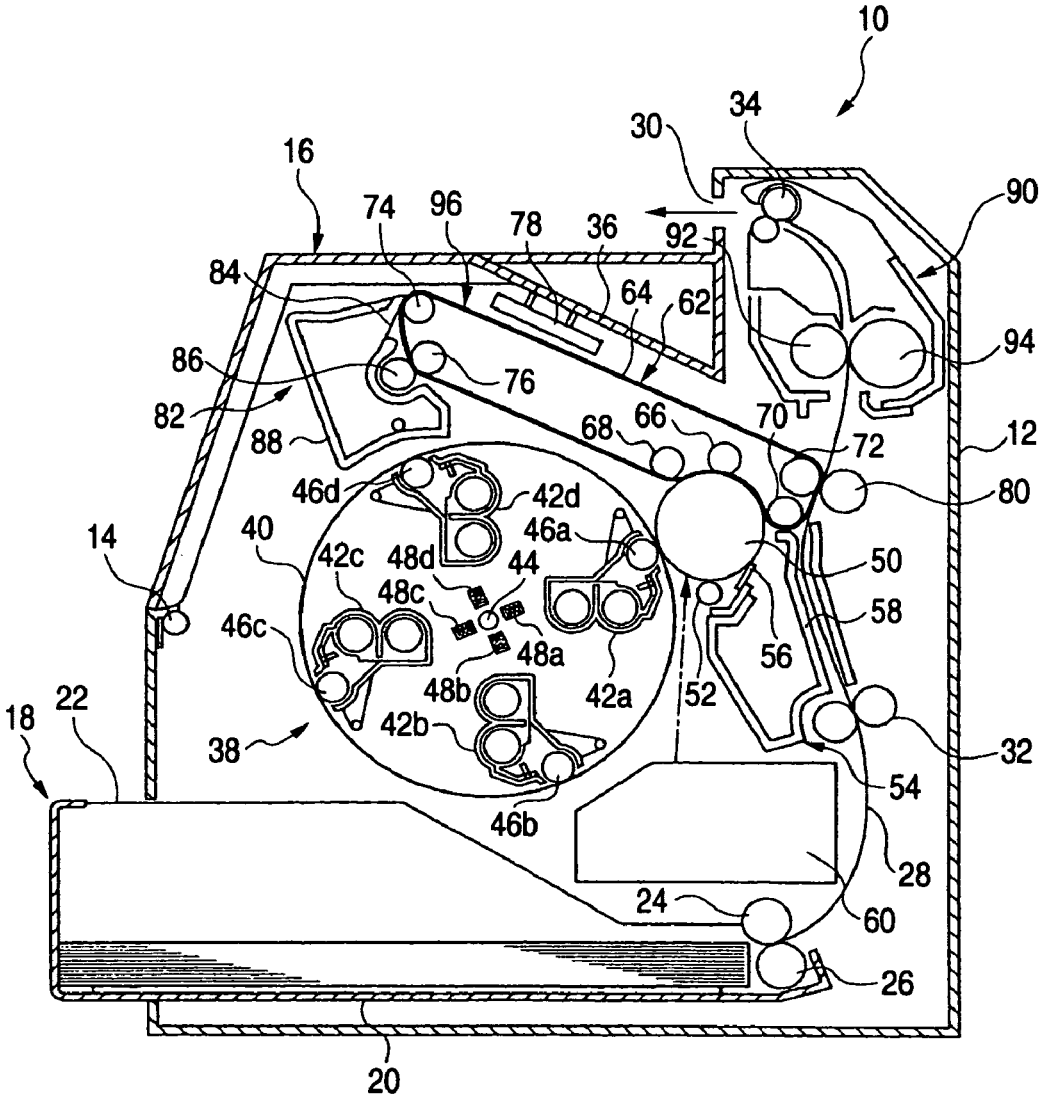
FIG. 1 is a diagram showing the outline of an image forming device pertaining to a first embodiment of the invention.

FIG. 1 shows the outline of an image forming device 10 pertaining to the first embodiment of the invention. The image forming device 10 of the first embodiment includes an image forming device body 12. An open/close cover 16 that is pivotable around a pivot point 14 is disposed at an upper portion of the image forming device body 12, and, for example, one paper supply unit 18 is disposed at a lower portion of the image forming device body 12.

The paper supply unit 18 includes a paper supply unit body 20 and a paper supply cassette 22 in which paper is accommodated. A feed roll 24 that supplies paper from the paper supply cassette 22 and a retard roll 26 that separates the paper to be supplied one sheet at a time are disposed at an upper portion in the vicinity of a deep end of the paper supply cassette 22.

A conveyance path 28 is a paper path from the feed roll 24 to a discharge port 30, and this conveyance path 28 is formed substantially vertically, from the paper supply unit 18 to a later-described fixing unit 90, in the vicinity of the deep side (right side of FIG. 1) of the image forming device body 12. A later-described secondary transfer roll 80 and a later-described secondary transfer backup roll 72 are disposed at an upstream side of the fixing unit 90 on the conveyance path 28, and registration rolls 32 are disposed at the upstream side of the secondary transfer roll 80 and the secondary transfer backup roll 72. Also, discharge rolls 34 are disposed in the vicinity of the discharge port 30 on the conveyance path 28.

Thus, the paper that is sent out by the feed roll 24 from the paper supply cassette 22 of the paper supply unit 18 is separated by the retard roll 26 so that only the uppermost sheet of paper is guided to the conveyance path 28, temporarily stopped by the registration rolls 32, passed between the later-described secondary transfer roll 80 and the later-described secondary transfer backup roll 72 at a timing, toner images are transferred to the paper, the transferred toner images are fixed by the fixing unit 90, and the paper is discharged by the discharge rolls 34 through the discharge port 30 to a discharge portion 36 disposed at an upper portion of the open/close cover 16. The discharge portion 36 is slanted so that the discharge port portion is low and gradually becomes higher towards the front direction (left direction of FIG. 1).

A rotary development unit 38 is disposed at, for example, a substantially central portion in the image forming device body 12. The rotary development unit 38 includes, inside a development unit body 40, development units 42*a* to 42*d* that respectively form toner images of the four colors of yellow, magenta, cyan and black, and the rotary development unit 38 rotates leftward (counter-clockwise direction in FIG. 1) around a rotary development unit center 44. The development units 42*a* to 42*d* respectively include development rolls 46*a* to 46*d* and are pressed in normal line directions of the development unit body 40 by elastic bodies 48*a* to 48*d* such as coil springs.

An image carrier 50 comprising, for example, a photosensitive body is disposed so as to abut against the rotary development unit 38. In a state where the development rolls 46*a* to 46*d* are not abutting against the image carrier 50, parts of the outer peripheries thereof project, for example, 2 mm in a radial direction from the outer periphery of the development unit body 40. Also, tracking rolls (not shown) of diameters slightly larger than the diameters of the development rolls 46*a* to 46*d* are disposed at both ends of each of the development rolls 46*a* to 46*d* so as to rotate coaxially with the development rolls 46*a* to 46*d*. In other words, the development rolls 46*a* to 46*d* of the development units 42*a* to 42*d* are disposed at the outer periphery of the development unit body 40 at respective intervals of 90° around the rotary development unit center 44, the tracking rolls of the development rolls 46*a* to 46*d* abut against flanges (not shown) disposed at both ends of the image carrier 50 to form a predetermined gap between the development rolls 46*a* to 46*d* and the image carrier 50, and a latent image on the image carrier 50 is developed by the toners of the respective colors.

A charger 52 comprising, for example, a charging roll that uniformly charges the image carrier 50 is disposed below the image carrier 50. Also, an image carrier cleaner 54 abuts against the image carrier 50 at a more upstream side than the charger 52 in the rotational direction of the image carrier 50. The image carrier cleaner 54 is configured by, for example, a cleaning blade 56 that scrapes off toner remaining on the image carrier 50 after primary transfer and a toner recovery bottle 58 that recovers the toner scraped off by the cleaning blade 56.

It should be noted that, for example, a rib is formed on the rear surface side (right side in FIG. 1) of the toner recovery bottle 58, and the rear surface side is curved, so that the paper is smoothly conveyed, and configures the conveyance path 28.

An exposure unit 60 that writes, to the image carrier 50 charged by the charger 52, the latent image using light beams such as laser light is disposed below the rotary development unit 38. Also, an intermediate transfer unit 62, at which the toner images visualized by the rotary development unit 38 are transferred at a primary transfer position and which conveys the toner images to a later-described secondary transfer position, is disposed above the rotary development unit 38.

The intermediate transfer unit 62 is configured by an intermediate transfer member 64 such as an intermediate transfer belt, a primary transfer roll 66, a wrap-in roll 68, a wrap-out roll 70, the secondary transfer backup roll 72, a scraper backup roll 74 and a brush backup roll 76. The intermediate transfer member 64 has elasticity and is pulled substantially flatly so as to have a long edge and a short edge above the rotary development unit 38. Also, the intermediate transfer member 64 includes an image carrier wrap region that wraps around and abuts against the image carrier 50 between the wrap-in roll 68 disposed below the long edge of the intermediate transfer member 64 and upstream of the primary transfer roll 66 and the wrap-out roll 70 disposed downstream of the primary transfer roll 66, is wrapped around a predetermined range of the image carrier 50, and follows the rotation of the image carrier 50. In this manner, the toner images on the image carrier 50 are superposed and primarily transferred to the intermediate transfer member 64 by the primary transfer roll 66 in the order of, for example, yellow, magenta, cyan and black, and the intermediate transfer member 64 conveys the primarily transferred toner images to the later-described secondary transfer roll 80.

It should be noted that the wrap-in roll 68 and the wrap-out roll 70 are separated from the image carrier 50.

Moreover, a planar portion (short edge) is formed at the rear side (right side surface of FIG. 1) of the intermediate transfer member 64 by the wrap-out roll 70 and the secondary transfer backup roll 72, and this planar portion becomes a secondary transfer portion and is configured to be exposed to the conveyance path 28.

It should be noted that the wrap-out roll 70 is disposed in the secondary transfer portion so that the space between the intermediate transfer member 64 and the conveyance path 28 has an angle of, for example, 12°.

The scraper backup roll 74 aids the scraping, by a later-described scraper 84, of toner remaining on the intermediate transfer member 64 after secondary transfer, and the brush backup roll 76 aids the scraping, by a later-described brush roll 86, of toner remaining on the intermediate transfer member 64 after secondary transfer.

A sensor 78 such as a reflective photosensor is disposed above the long edge of the intermediate transfer member 64 by being fixed to the rear surface (inner side) of the open/close cover 16. The sensor 78 reads the pitch of the toner formed on the intermediate transfer member 64, detects the position in the rotational direction of the intermediate transfer member 64 and conducts toner density detection.

The secondary transfer roll 80 opposes the secondary transfer backup roll 72 of the intermediate transfer unit 62 with the conveyance path 28 sandwiched therebetween. In other words, the space between the secondary transfer roll 80 and the secondary transfer backup roll 72 serves as the secondary transfer position in the secondary transfer portion. Due to the aid of the secondary transfer backup roll 72, the secondary transfer roll 80 transfers, to the paper and at the secondary transfer position, the toner images primarily transferred to the intermediate transfer member 64. Here, the secondary transfer roll 80 is separated from the intermediate transfer member 64 while the intermediate transfer member 64 rotates three times, i.e. while the intermediate transfer member 64 conveys the toner images of the three colors of yellow, magenta and cyan, and the secondary transfer roll 80 abuts against the intermediate transfer member 64 when the black toner image is transferred. It should be noted that a predetermined potential difference arises between the secondary transfer roll 80 and the secondary transfer backup roll 72, and in a case where the secondary transfer roll 80 has a high potential, the secondary transfer backup roll 72 is connected to a ground (GND).

The intermediate transfer member cleaner 82 abuts against a counter secondary transfer position side of the intermediate transfer unit 62. The intermediate transfer member cleaner 82 is configured by, for example, the scraper 84 that scrapes off and cleans the toner remaining on the intermediate transfer member 64 after secondary transfer, the brush roll 86 that further scrapes off toner remaining after the cleaning by the scraper 84, and the toner recovery bottle 88 that recovers the toner scraped off by the scraper 84 and the brush roll 86. The scraper 84 comprises, for example, a stainless steel thin plate, and a predetermined voltage is applied thereto. The brush roll 86 comprises, for example, a brush such as acrylic to which a conductive treatment has been administered. Also, while the intermediate transfer member 64 transfers the toner images, the scraper 84 and the brush roll 86 are separated from the intermediate transfer member 64, and these integrally abut against the intermediate transfer member 64 at a predetermined timing.

The fixing unit 90 is disposed above the secondary transfer position. The fixing unit 90 includes a heating roll 92 and a pressurizing roll 94, fixes, to the paper, the toner images secondarily transferred to the paper by the secondary transfer roll 80 and the secondary transfer backup roll 72, and conveys the paper to the discharge rolls 34.

An image forming unit 96 is one where the intermediate transfer unit 62, the image carrier 50, the charger 52, the image carrier cleaner 54 and the intermediate transfer member cleaner 82 are integrated. The image forming unit 96 is disposed directly below the discharge portion 36 of the open/close cover 16, e.g., so that the intermediate transfer unit 62 is disposed between the rotary development unit 38 and the fixing unit 90, and is loaded and unloaded by opening the open/close cover 16.

Next, the action of the first embodiment will be described.

When an image forming signal is sent, the image carrier 50 is uniformly charged by the charger 52, and light beams are emitted onto the charged image carrier 50 from the exposure unit 60 on the basis of the image signal. The light beams from the exposure unit 60 expose the surface of the image carrier 50 and a latent image is formed. As for the latent image of the image carrier 50 formed by the exposure unit 60, the toner images of yellow, magenta, cyan and black are developed by the rotary development unit 38 and superposed and primarily transferred to the intermediate transfer member 64. During primary transfer, waste toner remaining on the image carrier 50 is scraped off and recovered by the image carrier cleaner 54.

Paper accommodated in the paper supply cassette 22 is sent out by the feed roll 24 by a paper supply signal, separated by the retard roll 26 and guided to the conveyance path 28, temporarily stopped by the registration rolls 32, and guided between the secondary transfer roll 80 and the secondary transfer backup roll 72 at a timing. When the paper is guided between the secondary transfer roll 80 and the secondary transfer backup roll 72, the toner images primarily transferred to the intermediate transfer member 64 are secondarily transferred to the paper by the secondary transfer roll 80 and the secondary transfer backup roll 72. After secondary transfer, waste toner remaining on the intermediate transfer member 64 is scraped off and recovered by the intermediate transfer member cleaner 82.

The paper to which the toner images have been transferred is guided to the fixing unit 90, and the toner images are fixed to the paper by heat and pressure resulting from the heating roll 92 and the pressurizing roll 94. The paper to which the toner images have been fixed is discharged by the discharge rolls 34 through the discharge port 30 to the discharge portion 36.

Next, the method of loading and unloading the image forming unit 96 of the first embodiment will be described.

Figure 2:
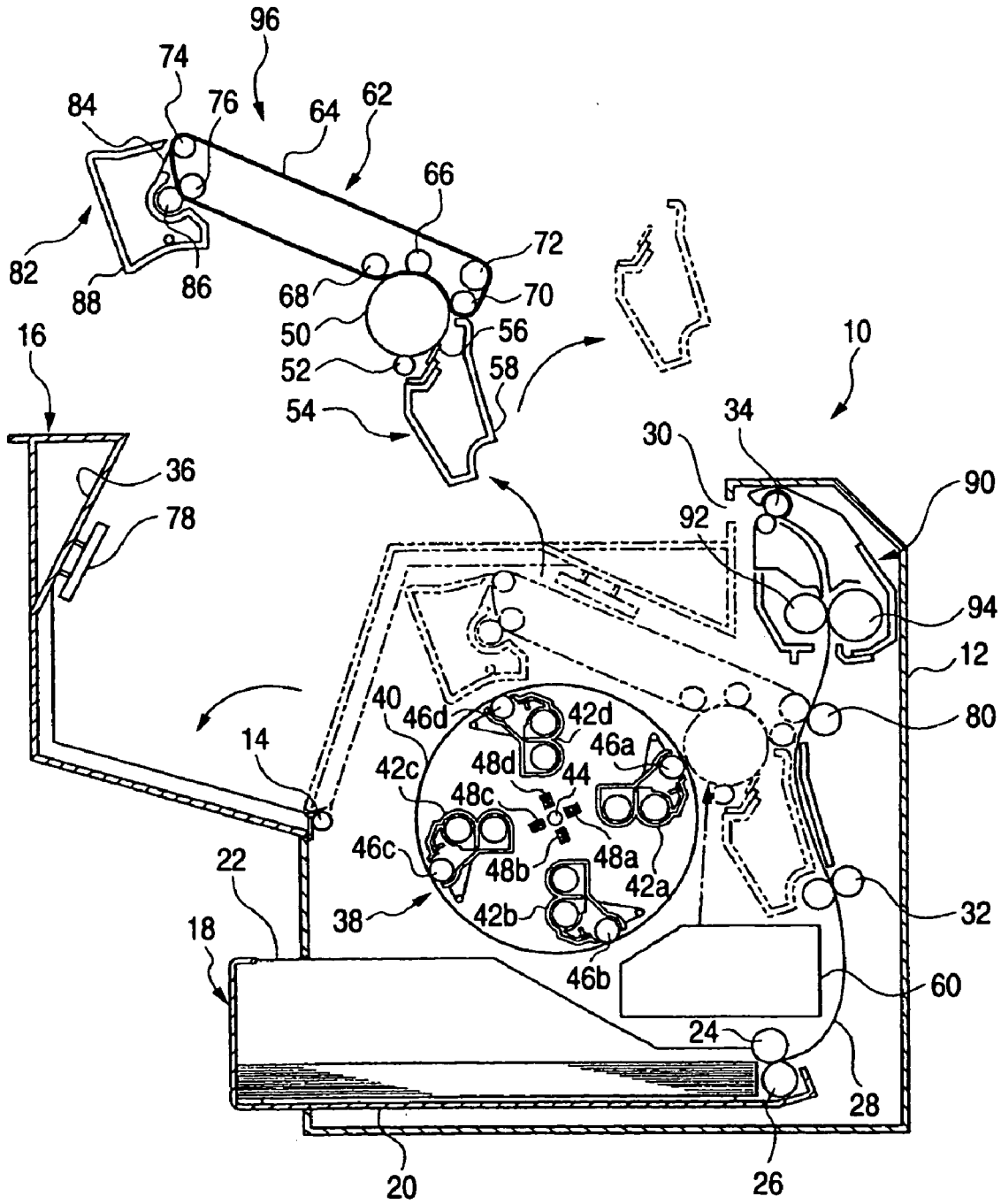
FIG. 2 is a diagram showing a state where an image forming unit of the first embodiment is removed from an image forming device body.

FIG. 2 shows a state where the image forming unit 96 of the first embodiment is removed from the image forming device body 12. When the image forming unit 96 is to be removed from the image forming device 10, the upper portion of the image forming device body 12 is opened by pivoting the open/close cover 16 of the image forming device body 12 around the pivot point 14. The image forming unit 96 is disposed so that the intermediate transfer unit 62 and the image carrier 50 are positioned between the fixing unit 90 and the rotary development unit 38, and the image forming unit 96 is removed in a diagonally forward direction (diagonally leftward and upward in FIG. 2) from the image forming device body 12 through the space between the fixing unit 90 and the rotary development unit 38. In this manner, the image forming unit 96 is removed without opening the conveyance path 28.

Also, in a state where the image forming unit 96 has been removed from the image forming device body 12, the image carrier 50 and the image carrier cleaner 54, as well as the intermediate transfer unit 62 and the intermediate transfer member cleaner 82, respectively become loadable and unloadable, so that it becomes possible to easily replace each member in accordance with the lifespan thereof.

When the image forming unit 96 is to be attached to the image forming device body 12, the image forming unit 96 is attached in the opposite sequence of the sequence for when the image forming unit 96 is removed from the image forming device 10.

Figure 3:
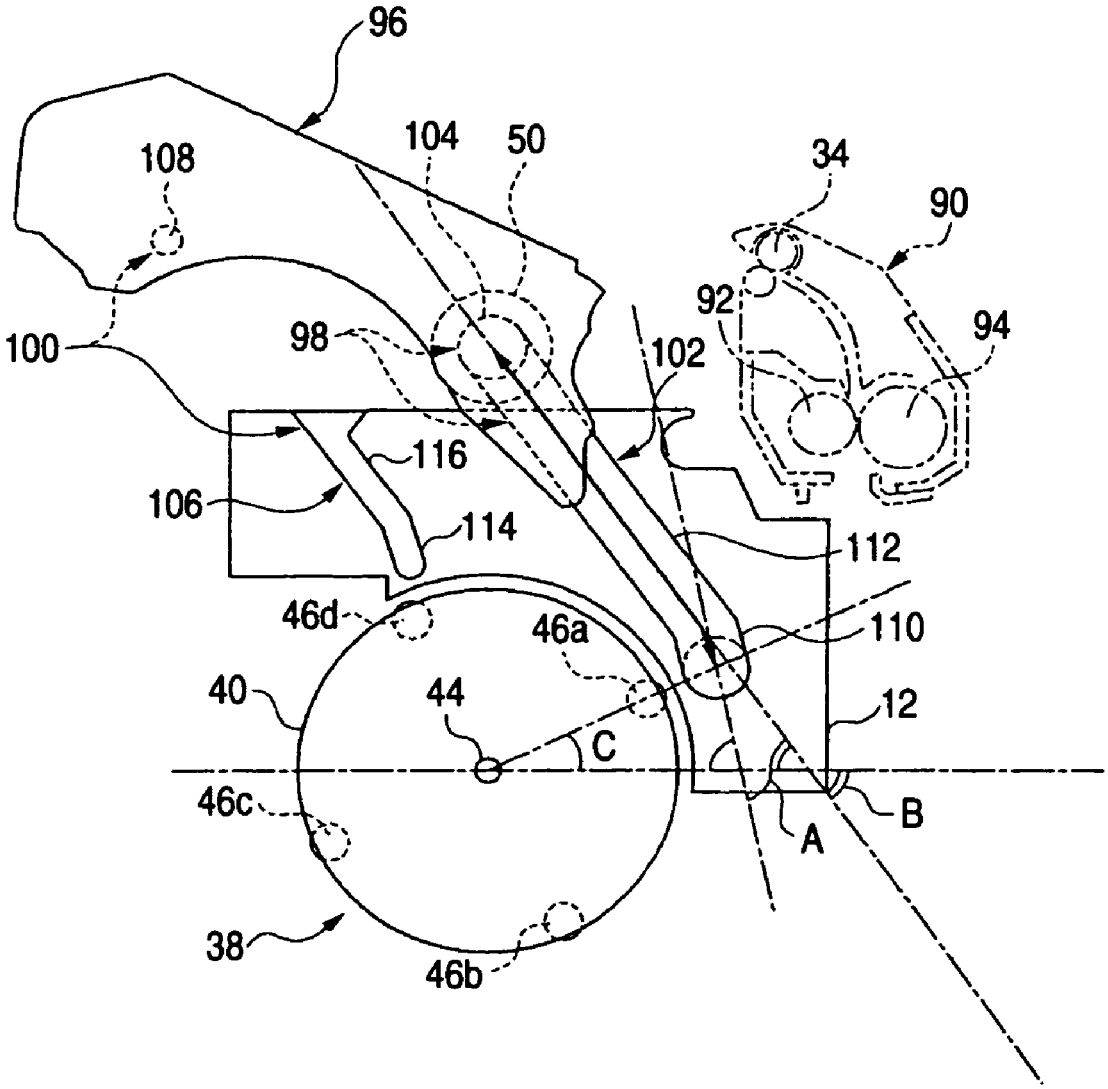
FIG. 3 is a diagram schematically showing a direction in which the image forming unit is loaded in and unloaded from the image forming device body.
Figure 4:
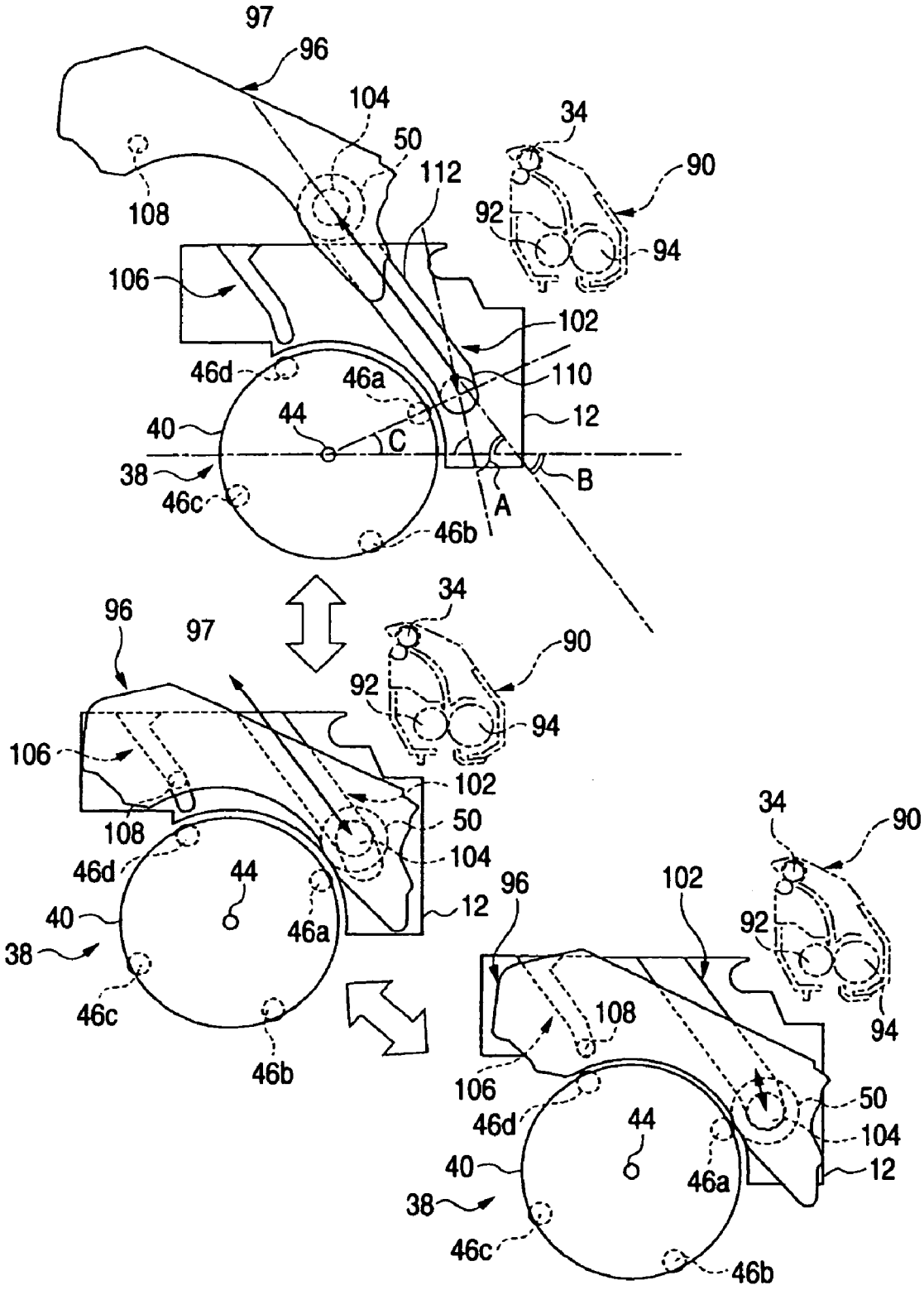
FIG. 4 is a diagram schematically showing a direction and state in which the image forming unit is loaded in and unloaded from the image forming device body.

FIGS. 3 and 4 schematically show the direction in which the image forming unit 96 is loaded in and unloaded from the image forming device body 12. The image forming unit 96 is guided along a main guide section 98 and an auxiliary guide section 100, and loaded in and unloaded from the image forming device body 12 in a predetermined direction. The main guide section 98 is configured by a guide groove 102 disposed in the image forming device body 12 and a projection portion 104 disposed in the image forming unit 96. The projection portion 104 is formed in, for example, a cylindrical shape that is coaxial with the image carrier 50 and engages with the guide groove 102, and is configured to move along the guide groove 102. The auxiliary guide section 100 is configured by an auxiliary groove 106 disposed in the image forming device body 12 and a projection portion 108 disposed in the image forming unit 96. The projection portion 108 is formed in, for example, a cylindrical shape that engages with the auxiliary groove 106, and is configured to move along the auxiliary groove 106. Also, an upper end of the auxiliary groove 106 is widely open to allow the projection portion 108 to easily engage therewith.

A contact/separation guide groove 110 is formed in a lower portion of the guide groove 102 at an angle A with respect to a horizontal line, and a movement guide groove 112 is formed in an upper portion of the guide groove 102 at an angle B with respect to a horizontal line. Also, a contact/separation auxiliary guide groove 114 is formed in a lower portion of the auxiliary groove 106 at an angle A with respect to a horizontal line, and a movement auxiliary guide groove 116 is formed in an upper portion of the auxiliary groove 106 at an angle B with respect to a horizontal line. The angle A is, for example, 70°, and the angle B is, for example, 55°. Thus, when the projection portion 104 and the projection portion 108 are respectively moved along the contact/separation guide groove 110 and the contact/separation auxiliary guide groove 114, the image forming unit 96 moves in directions in which it contacts and separates from a substantially tangential direction of the rotary development unit 38. Also, when the projection portion 104 and the projection portion 108 are respectively moved along the movement guide groove 112 and the movement auxiliary guide groove 116, the image forming unit 96 moves in a substantially tangential direction passing through the development position of the rotary development unit 38. In this manner, because the projection portion 104 and the projection portion 108 respectively move along the guide groove 102 and the auxiliary groove 106, the loading and unloading of the image forming unit 96 in and from the image forming device body 12 in a substantially tangential direction passing through the development position of the rotary development unit 38 with a predetermined orientation are allowed.

Also, the lower end of the guide groove 102 is disposed on a normal line of the rotary development unit 38 that extends at an angle C from the rotary development unit center 44 with respect to a horizontal line through the axis (center) of the image carrier 50 and the projection portion 104, and is formed to support the image carrier 50 and the projection portion 104. The angle C is, for example, 25°. In other words, the projection portion 104 is supported at the lower end of the guide groove 102, whereby the image carrier 50 is positioned at a developable predetermined position and is not displaced even if it receives pressure from the rotary development unit 38. In this manner, the image forming unit 96 is prevented from contacting the fixing unit 90 and sustaining damage, and is easily loaded in and unloaded from the image forming device body 12.

Figure 5:
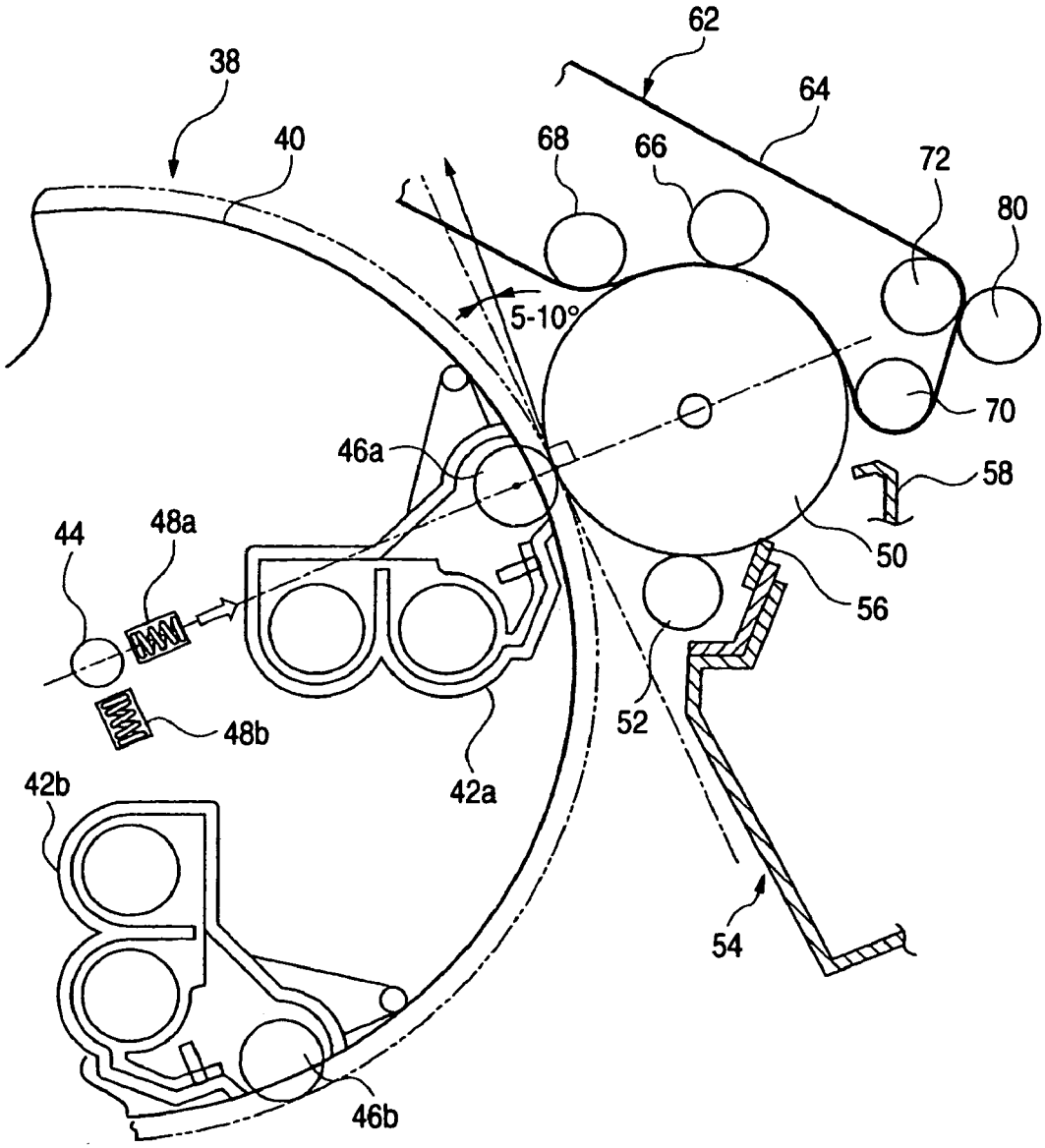
FIG. 5 is a diagram showing a direction in which an image carrier of the image forming unit comes into contact with and separates from a rotary development unit.

FIG. 5 shows the details of the directions in which the image carrier 50 of the image forming unit 96 contacts and separates from the rotary development unit 38. As described above, when the image forming unit 96 is guided by the main guide section 98 and the auxiliary guide section 100, the image carrier 50 is loaded in and unloaded from a substantially perpendicular direction (substantially tangential direction passing through the development position of the rotary development unit 38) with respect to a normal line passing through the development position of the rotary development unit 38. In this manner, the direction in which the image forming unit 96 is loaded in and unloaded from the image forming device body 12 and in which the image carrier 50 is separated from the rotary development unit 38 is 5° to 10° above, for example, the tangential direction passing through the development position of the rotary development unit 38.

Also, when the image carrier 50 abuts against any of the development rolls 46*a* to 46*d* other than on the normal line passing through the development position of the rotary development unit 38, the image carrier 50 is loaded in and unloaded from a substantially perpendicular line direction with respect to, for example, the line portion joining the center of the image carrier 50 with the center of any of the development rolls 46*a* to 46*d* abutting against the image carrier 50.

It should be noted that, although FIG. 5 shows the direction in which the image carrier 50 of the image forming unit 96 contacts and separates from the rotary development unit 38 in a state where the rotary development unit 38 is developable, the invention may also be configured so that the image carrier 50 moves in the direction in which it contacts and separates from the rotary development unit 38 in a state where the rotary development unit 38 has been evacuated to a position at which the development rolls 46*a* to 46*d* do not abut against the image carrier 50.

Next, a second embodiment of the invention will be described on the basis of the drawings.

Figure 6:
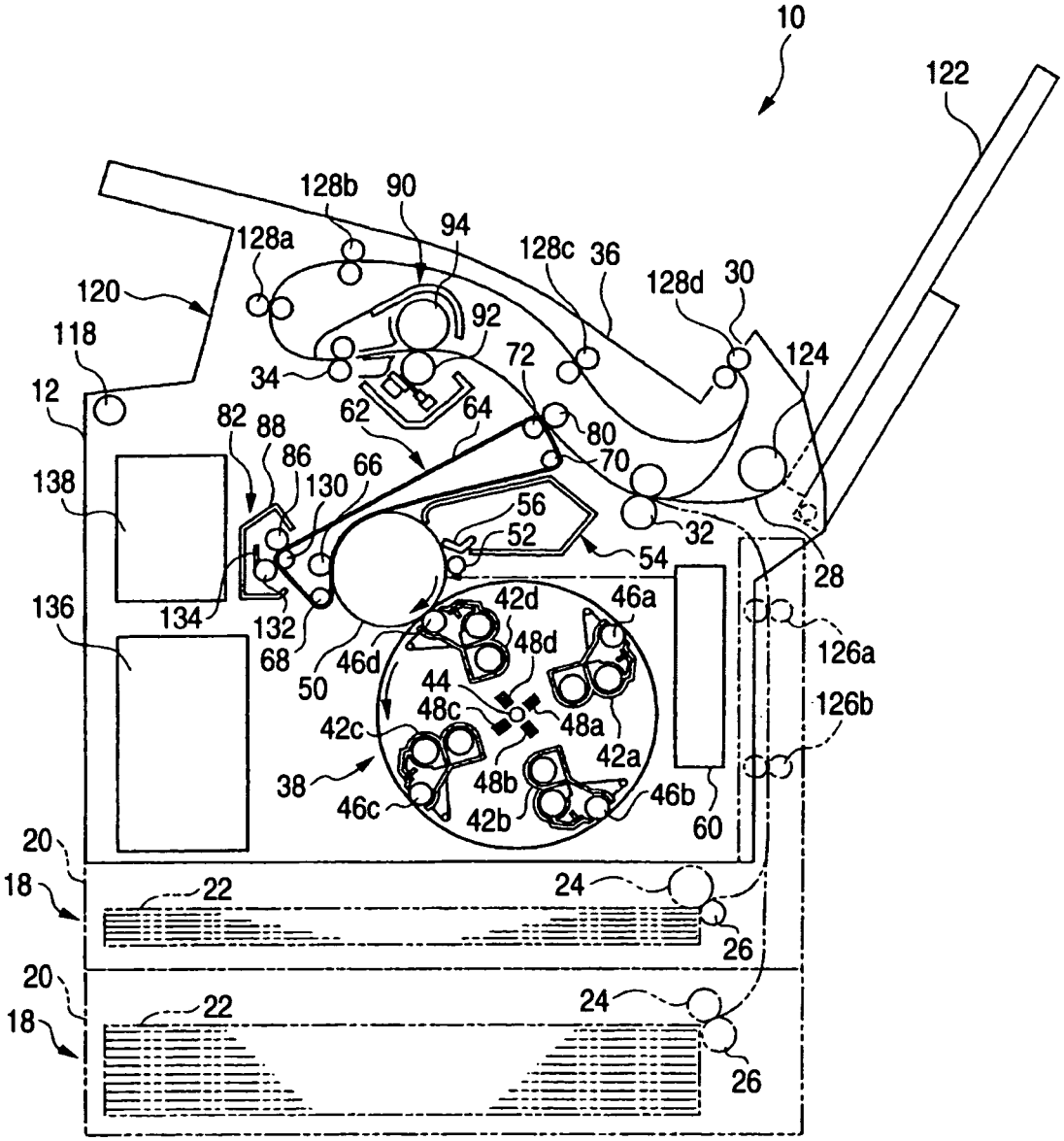
FIG. 6 is a diagram showing the outline of an image forming device pertaining to a second embodiment of the invention.

FIG. 6 shows the outline of the image forming device 10 pertaining to the second embodiment.

It should be noted that, with respect to the image forming device 10 pertaining to the second embodiment, the same reference numerals are given to parts that are substantially the same as those of the image forming device 10 pertaining to the first embodiment.

In the image forming device 10 of the second embodiment, a conveyance portion 120 that is pivotable around a pivot point 118 is disposed at the upper portion of the image forming device body 12. Also, a manual feed tray 122 is pivotably disposed at the counter pivot point side of the conveyance portion 120. A pickup roll 124 that supplies paper from the manual feed tray 122 is disposed at the conveyance portion 120 side of the manual feed tray 122.

Two paper supply units 18 can be disposed as options at the lower portion of the image forming device body 12. Each of the optional paper supply units 18 includes a paper supply unit body 20 and a paper supply cassette 22 in which the paper is accommodated. A feed roll 24 that supplies the paper from the paper supply cassette 22 and a retard roll that separates and treats the supplied paper one sheet at a time are disposed at the upper portion in the vicinity of the deep end of each paper supply cassette 22.

The conveyance path 28 is a paper path from the pickup roll 124 to the discharge port 30, and this conveyance path 28 is formed substantially horizontally, from the manual feed tray 122 to the fixing unit 90, at the upper portion of the image forming device body 12, and is formed so as to turn back above the fixing unit 90 at the front side (left side of FIG. 6) of the conveyance portion 120 and further turn back above the front side at the rear side (right side of FIG. 6) of the conveyance portion 120. The secondary transfer roll 80 and the secondary transfer backup roll 72 are disposed at an upstream side of the fixing unit 90 on the conveyance path 28, and the registration rolls 32 are disposed at the upstream side of the secondary transfer roll 80 and the secondary transfer backup roll 72. Also, the paper sent out by the feed roll 24 from the optional paper supply units 18 is separated and treated by the retard roll 26 so that only the uppermost sheet of paper is guided to the conveyance path 28 via vertical conveyance rolls 126*a* and 126*b*. Conveyance rolls 128*a* to 128*d* are disposed between the fixing unit 90 on the conveyance path 28 and the discharge port 30.

Thus, only the uppermost sheet of the paper that is sent out by the pickup roll 124 from the manual feed tray 122 is guided to the conveyance path 28, temporarily stopped by the registration rolls 32, passed between the secondary transfer roll 80 and the secondary transfer backup roll 72 at a timing, toner images are transferred to the paper, the transferred toner images are fixed by the fixing unit 90, and the paper is discharged through the discharge port 30 via the conveyance rolls 128*a* to 128*d* to the discharge portion 36 disposed at an upper portion of the conveyance portion 120. The discharge portion 36 is slanted so that the discharge port portion is low and gradually becomes higher towards the front direction (left direction of FIG. 6).

The rotary development unit 38 is disposed at, for example, the substantially central portion in the image forming device body 12. The image carrier 50 comprising, for example, a photosensitive body is disposed so as to abut against the rotary development unit 38, and the charger 52 comprising, for example, a charging roll that uniformly charges the image carrier 50 is disposed at the rear side (right side of FIG. 6) of the image carrier 50. Also, the image carrier cleaner 54 abuts against the image carrier 50 at a more upstream side than the charger 52 in the rotational direction of the image carrier 50. The image carrier cleaner 54 is configured by, for example, the cleaning blade 56 that scrapes off toner remaining on the image carrier 50 after primary transfer and the toner recovery bottle 58 that recovers the toner scraped off by the cleaning blade 56.

It should be noted that, for example, a rib is formed on the rear surface side (right side in FIG. 6) of the toner recovery bottle 58, and the rear surface side is curved, so that the paper is smoothly conveyed, and configures the conveyance path 28.

The exposure unit 60 that writes, to the image carrier 50 charged by the charger 52, the latent image using light beams such as laser light is disposed at the rear side (right side of FIG. 6) of the rotary development unit 38. Also, the intermediate transfer unit 62, at which the toner images visualized by the rotary development unit 38 are transferred at the primary transfer position and which conveys the toner images to the secondary transfer position, is disposed above the image carrier 50.

The intermediate transfer unit 62 of the second embodiment is configured by the intermediate transfer member 64 such as an intermediate transfer belt, the primary transfer roll 66, the wrap-in roll 68, the wrap-out roll 70, the secondary transfer backup roll 72 and a belt cleaner backup roll 130. The intermediate transfer member 64 has elasticity and is pulled substantially flatly so as to have a long edge and a short edge above the image carrier 50.

The belt cleaner backup roll 130 aids the transfer of toner remaining on the intermediate transfer member 64 after secondary transfer to a later-described belt cleaner roll 132. The intermediate transfer member cleaner 82 abuts against the counter secondary transfer position side of the intermediate transfer unit 62. The intermediate transfer member cleaner 82 is configured by, for example, the brush roll 86 that scrapes off toner remaining on the intermediate transfer member 64 after secondary transfer, the belt cleaner roll 132 that further transfers and cleans toner remaining after the brush roll 86 has scraped off the toner, a scraper 134 that scrapes off toner transferred to the belt cleaner roll 132, and the toner recovery bottle 88 that recovers the scraped off toner.

Also, the fixing unit 90 is disposed downstream of the secondary transfer position above the intermediate transfer unit 62.

A power supply unit 136 is disposed in the vicinity of the front side surface (left side surface of FIG. 6) of the image forming device body 12 and supplies power to the respective portions configuring the image forming device 10.

A control unit 138 that controls the respective portions configuring the image forming device 10 is disposed above the power supply unit 136.

The image forming unit 96 is one where the intermediate transfer unit 62, the image carrier 50, the charger 52, the image carrier cleaner 54 and the intermediate transfer member cleaner 82 are integrated. The image forming unit 96 is disposed between the fixing unit 90 and the rotary development unit 38, and is loaded and unloaded by opening the conveyance portion 120.

Next, the action of the second embodiment will be described.

When the image forming signal is sent from the control unit 138, the image carrier 50 is uniformly charged by the charger 52, and light beams are emitted onto the charged image carrier 50 from the exposure unit 60 on the basis of the image signal. The light beams from the exposure unit 60 expose the surface of the image carrier 50 and a latent image is formed. As for the latent image of the image carrier 50 formed by the exposure unit 60, the toner images of yellow, magenta, cyan and black are developed by the rotary development unit 38 and superposed and primarily transferred to the intermediate transfer member 64. During primary transfer, waste toner remaining on the image carrier 50 is scraped off and recovered by the image carrier cleaner 54.

Paper accommodated in the manual feed tray 122 is sent out by the pickup roll 124 by a paper supply signal, guided to the conveyance path 28, temporarily stopped by the registration rolls 32, and guided between the secondary transfer roll 80 and the secondary transfer backup roll 72 at a timing. When the paper is guided between the secondary transfer roll 80 and the secondary transfer backup roll 72, the toner images primarily transferred to intermediate transfer member 64 are secondarily transferred to the paper by the secondary transfer roll 80 and the secondary transfer backup roll 72. After secondary transfer, waste toner remaining on the intermediate transfer member 64 is scraped off and recovered by the intermediate transfer member cleaner 82.

The paper to which the toner images have been transferred is guided to the fixing unit 90, and the toner images are fixed to the paper by heat and pressure resulting from the heating roll 92 and the pressurizing roll 94. The paper to which the toner images have been fixed is discharged by the discharge rolls 34 and the conveyance rolls 128*a* to 128*d* through the discharge port 30 to the discharge portion 36.

Next, the method of loading and unloading the image forming unit 96 of the second embodiment will be described.

Figure 7:
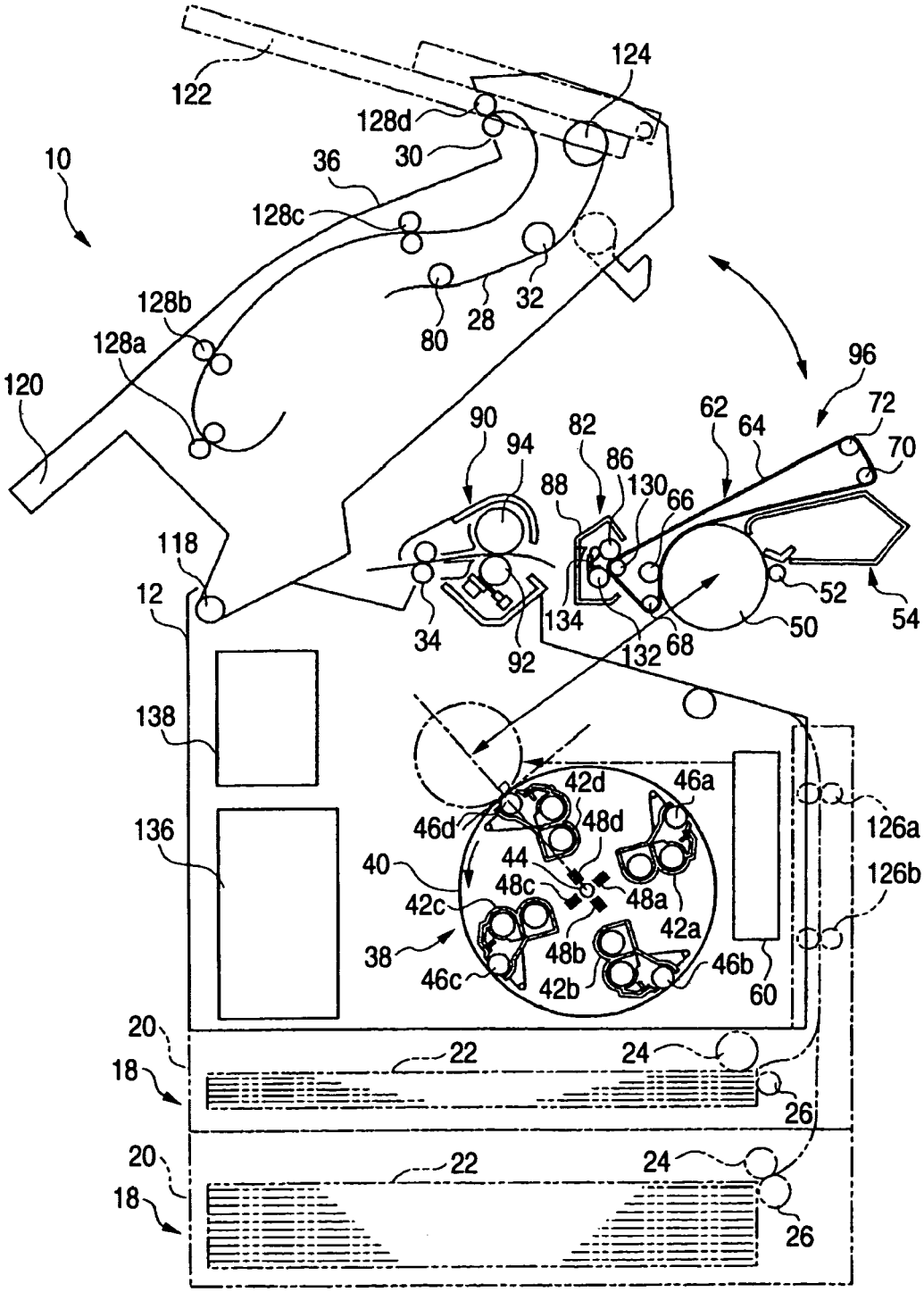
FIG. 7 is a diagram showing a state where an image forming unit of the second embodiment is removed from an image forming device body.

FIG. 7 shows a state where the image forming unit 96 of the second embodiment is removed from the image forming device body 12. When the image forming unit 96 is to be removed from the image forming device 10, the upper portion of the image forming device body 12 is opened by pivoting the conveyance portion 120 of the image forming device body 12 around the pivot point 118. The image forming unit 96 is removed in a diagonally rearward direction (diagonally rightward and upward in FIG. 7) from the image forming device body 12 through the space between the fixing unit 90 fixed at the image forming device body 12 and the rotary development unit 38. The image carrier 50 moves in a substantially perpendicular line direction (substantially tangential direction passing through the development position of the development unit 38) with respect to a normal line passing through the development position of the rotary development unit 38, so that the image forming unit 96 is loaded in and unloaded from the image forming device body 12. It should be noted that it is preferable to dispose a guide section so that the image forming unit 96 is guided in a predetermined direction and loaded and unloaded. In this manner, the image forming unit 96 of the second embodiment is removed by opening the conveyance path 28.

When the image forming unit 96 is to be attached to the image forming device body 12, the image forming unit 96 is attached in the opposite sequence of the sequence for when the image forming unit 96 is removed from the image forming device 10.

Next, a third embodiment of the invention will be described on the basis of the drawings.

Figure 8:
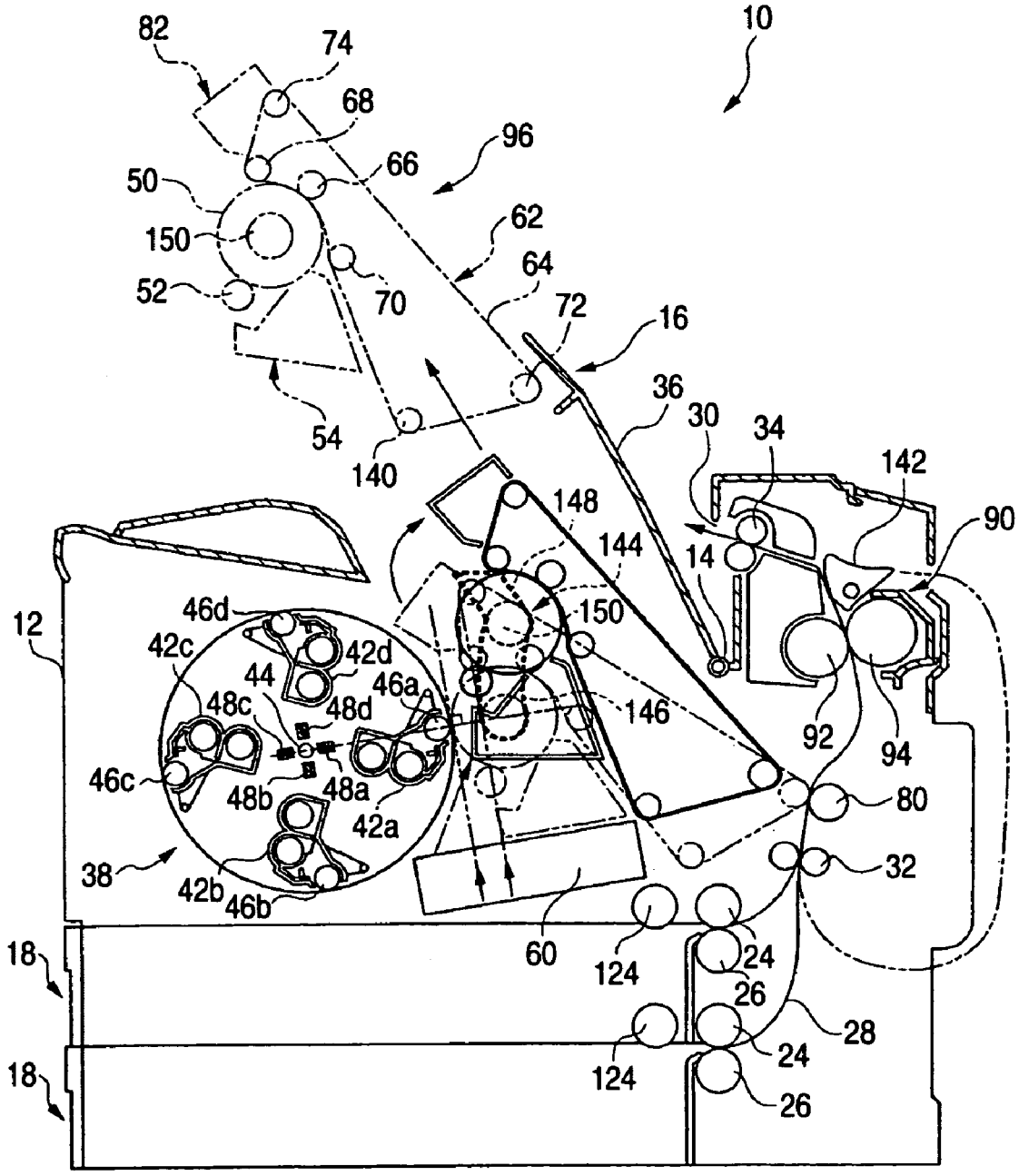
FIG. 8 is a diagram showing the outline of an image forming device pertaining to a third embodiment of the invention and a state where an image forming unit is removed.

FIG. 8 shows the outline of the image forming device 10 pertaining to the third embodiment of the invention and a state where the image forming unit 96 is removed.

It should be noted that, with respect to the image forming device 10 pertaining to the third embodiment, the same reference numerals are given to parts that are substantially the same as those of the image forming device 10 pertaining to the first and second embodiments.

In the image forming device 10 of the third embodiment, the open/close cover 16 that is pivotable around the pivot point 14 is disposed behind (right side of FIG. 8) the upper portion of the image forming device body 12. Two paper supply units 18 are disposed at the lower portion of the image forming device body 12.

The conveyance path 28 is a paper path from the feed roll 24 to the discharge port 30, and this conveyance path 28 is formed substantially vertically, from the paper supply units 18 to the fixing unit 90, in the vicinity of the rear side (right side surface of FIG. 8) of the image forming device body 12. The secondary transfer roll 80 and the secondary transfer backup roll 72 are disposed at the upstream side of the fixing unit 90 on the conveyance path 28, and the registration rolls 32 are disposed at the upstream side of the secondary transfer roll 80 and the secondary transfer backup roll 72. Also, discharge rolls 34 are disposed in the vicinity of the discharge port 30 on the conveyance path 28.

Thus, the paper that is sent out from the paper supply units 18 is guided to the conveyance path 28, temporarily stopped by the registration rolls 32, passed between the secondary transfer roll 80 and the secondary transfer backup roll 72 at a timing, toner images are transferred to the paper, the transferred toner images are fixed by the fixing unit 90, and the paper is discharged by the discharge rolls 34 through the discharge port 30 to the discharge portion 36 disposed at the upper portion of the open/close cover 16. However, in a case where an optional reversal device (not shown) is disposed and two-sided printing is set, the discharge rolls 34 are reversed and a claw portion 142 is switched, whereby the paper is sent to a reversal path and again returned to the registration rolls 32.

The rotary development unit 38 is disposed at, for example, the substantially central portion of the front side (left-side center portion of FIG. 8) in the image forming device body 12. The image carrier 50 comprising, for example, a photosensitive body is disposed so as to abut against the rear side (right side of FIG. 8) of the rotary development unit 38, and the charger 52 comprising, for example, a charging roll that uniformly charges the image carrier 50 is disposed below the image carrier 50.

The exposure unit 60 that writes, to the image carrier 50 charged by the charger 52, the latent image using light beams such as laser light is disposed below the image carrier 50. Also, the intermediate transfer unit 62, at which the toner images visualized by the rotary development unit 38 are transferred at the primary transfer position and which conveys the toner images to the secondary transfer position, is disposed at the rear side from above the image carrier 50.

The intermediate transfer unit 62 is configured by the intermediate transfer member 64 such as an intermediate transfer belt, the primary transfer roll 66, the wrap-in roll 68, the wrap-out roll 70, a tension roll 140, the secondary transfer backup roll 72 and the scraper backup roll 74. The tension roll 140 pulls the intermediate transfer member 64 to make the tension of the intermediate transfer member 64 into a predetermined tension. The fixing unit 90 is disposed above the secondary transfer position.

The image forming unit 96 is one where the intermediate transfer unit 62, the image carrier 50, the charger 52, the image carrier cleaner 54 and the intermediate transfer member cleaner 82 are integrated. The image forming unit 96 is disposed between the rotary development unit 38 and the fixing unit 90 directly below the discharge portion 36 of the open/close cover 16, and is guided by, for example, a guide section 144 and loaded and unloaded by opening the open/close cover 16.

Next, the loading/unloading method of the image forming unit according to the third embodiment will be described.

As shown in FIG. 8, when the image forming unit 96 is to be removed from the image forming device 10, the upper portion of the image forming device body 12 is opened by pivoting the open/close cover 16 of the image forming device body 12 around the pivot point 14. The image forming unit 96 is disposed between the fixing unit 90 and the rotary development unit 38, and the image forming unit 96 is guided by the guide section 144 and removed in a diagonally forward direction (diagonally leftward and upward in FIG. 8) from the image forming device body 12 through the space between the fixing unit 90 and the rotary development unit 38.

The guide section 144 is configured by a pivot guide groove 146 and a movement guide groove 148 disposed in, for example, the image forming device body 12 and a projection portion 150 disposed in the image forming unit 96. The projection portion 150 is formed in, for example, a cylindrical shape that is coaxial with the image carrier 50 and engages with the pivot guide groove 146 and the movement guide groove 148, and is configured to move along the pivot guide groove 146 and the movement guide groove 148.

When the image forming unit 96 is loaded and unloaded, the pivot guide groove 146 guides the image forming unit 96 so that the image forming unit 96 moves in a substantial arc. When the image forming unit 96 is guided by the pivot guide groove 146 and moves, the image carrier 50 moves in a substantial arc, and this substantial arc substantially contacts a line parallel to a tangential line passing through the development position of the rotary development unit 38 at the lower end of the pivot guide groove 146. Namely, when the image forming unit 96 is loaded and unloaded, the image carrier 50 moves in a substantially tangential direction passing through the development position of the rotary development unit 38 at the lower end of the pivot guide groove 146. The movement guide groove 148 is formed continuously with the pivot guide groove 146 and guides the image forming unit 96 substantially linearly so that the image forming unit 96 does not contact the image forming device body 12 and the open/close cover 16 when the image forming unit 96 is loaded and unloaded. In this manner, when the image forming unit 96 is removed from the image forming device body 12 and causes the projection portion 150 to move along the pivot guide groove 146 and the movement guide groove 148, the image forming unit 96 moves in a substantial arc in a substantially tangential direction passing through the development position of the rotary development unit 38 and is removed in a diagonally frontward direction (diagonally leftward and upward in FIG. 8).

Also, the projection portion 150 is supported at the lower end of the pivot guide groove 146, whereby the image carrier 50 is positioned at a developable predetermined position and is not displaced even if it receives pressure from the rotary development unit 38. The image forming unit 96 is prevented from contacting the fixing unit 90 and the image forming device body 12 and sustaining damage, and is easily loaded in and unloaded from the image forming device body 12.

In this manner, the image forming unit 96 is removed without opening the conveyance path 28.

When the image forming unit 96 is to be attached to the image forming device body 12, the image forming unit 96 is attached in the opposite sequence of the sequence for when the image forming unit 96 is removed from the image forming device 10.

Next, a modified example of the third embodiment of the invention will be described on the basis of the drawings.

Figure 9:
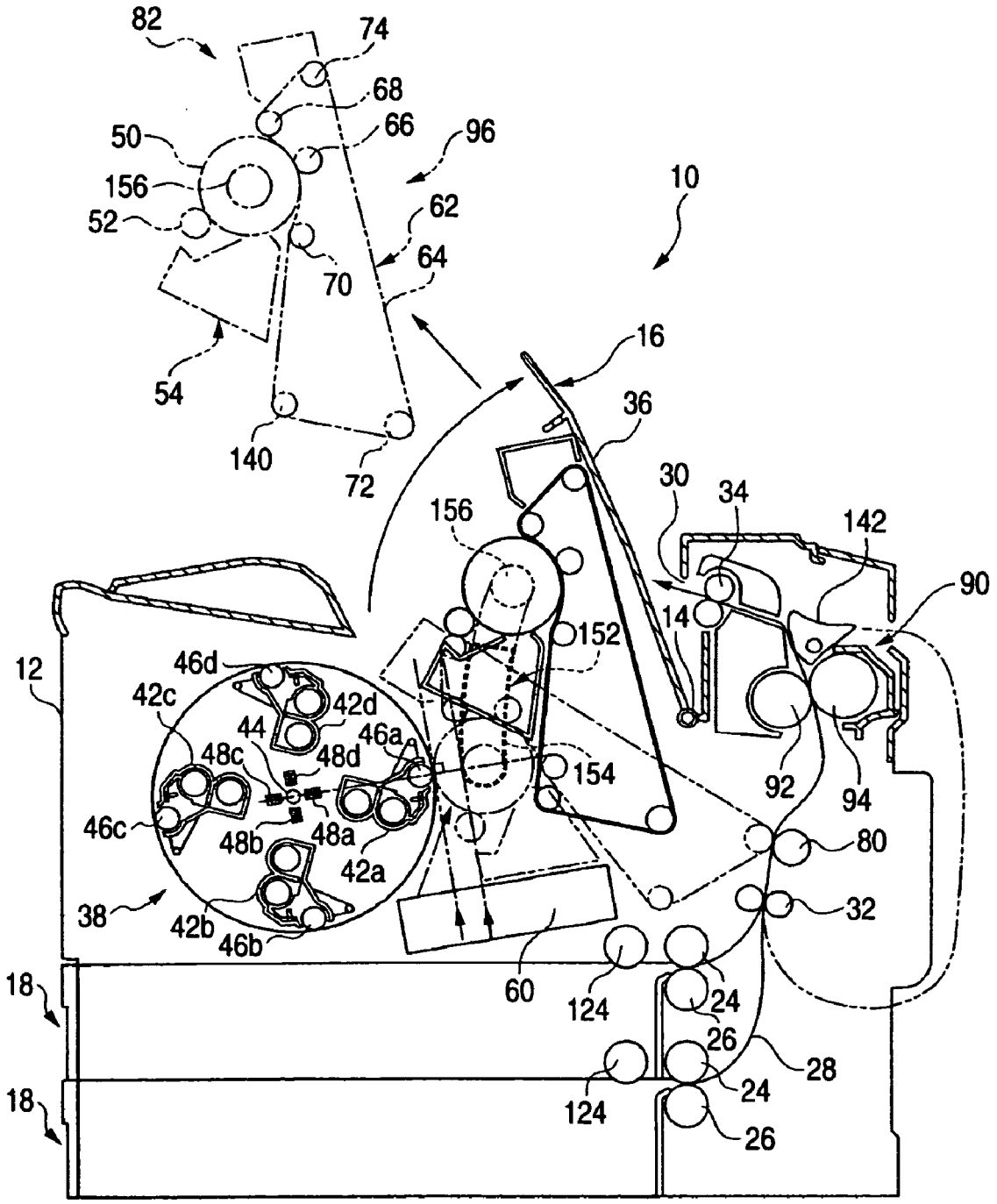
FIG. 9 is a diagram showing the outline of a modified example of an image forming device pertaining to a third embodiment of the invention and a state where an image forming unit is removed.

FIG. 9 shows the outline of the modified example of the image forming device 10 pertaining to the third embodiment of the invention and shows a state where the image forming unit 96 is removed.

It should be noted that, with respect to the modified example of the image forming device 10 pertaining to the third embodiment, the same reference numerals are given to parts that are substantially the same as those of the image forming device 10 pertaining to the third embodiment.

The modified example of the image forming device 10 of the third embodiment is different from the image forming device 10 of the third embodiment in that here the image forming unit 96 is fixed inside the image forming device body 12 to the lower surface of the open/close cover 16 by a fixing member (not shown) and a guide section 152 is disposed so that when the image forming unit 96 is loaded and unloaded, it moves together with the open/close cover 16 in a substantial arc.

As shown in FIG. 9, when the image forming unit 96 is to be removed from the image forming device 10, the upper portion of the image forming device body 12 is opened by pivoting the open/close cover 16 of the image forming device body 12 around the pivot point 14. One end at the counter secondary transfer position side of the image forming unit 96 is fixed to the lower surface of the open/close cover 16, and the image forming unit 96 is guided by the guide section 152 and moves together with the open/close cover 16 in a substantial arc. Thus, when the open/close cover 16 opens the upper portion of the image forming device body 12, the image forming unit 96 is guided out from the image forming device body 12. Also, when the open/close cover 16 opens the upper portion of the image forming device body 12, the image forming unit 96 is loaded in and unloaded from the open/close cover 16.

The guide section 152 is configured by, for example, a pivot guide groove 154 disposed in the image forming device body 12 and a projection portion 156 disposed in the image forming unit 96. The projection portion 156 is formed in, for example, a cylindrical shape that is coaxial with the image carrier 50 and engages with the pivot guide groove 154, and is configured to move along the pivot guide groove 154.

When the image forming unit 96 is loaded and unloaded, the pivot guide groove 154 guides the image forming unit 96 so that the image forming unit 96 moves in a substantial arc. When the image forming unit 96 is guided by the pivot guide groove 154 and moves, the image carrier 50 moves in a substantial arc, and this substantial arc substantially contacts a line parallel to a tangential line passing through the development position of the rotary development unit 38 at the lower end of the pivot guide groove 154. Namely, when the image forming unit 96 is loaded and unloaded, the image carrier 50 moves in a substantially tangential direction passing through the development position of the rotary development unit 38 at the lower end of the pivot guide groove 154.

In this manner, when the image forming unit 96 is to be removed from the image forming device body 12 and the open/close cover 16 is opened and the projection portion 156 is caused to move along the pivot guide groove 154, the image forming unit 96 moves in a substantial arc in a substantially tangential direction passing through the development position of the rotary development unit 38 and is guided out from the image forming device body 12. After the image forming unit 96 is guided out from the image forming device body 12, it is removed from the open/close cover 16.

Also, the projection portion 156 is supported at the lower end of the pivot guide groove 154, whereby the image carrier 50 is positioned at a developable predetermined position and is not displaced even if it receives pressure from the rotary development unit 38. In this manner, the image forming unit 96 is prevented from contacting the fixing unit 90 and the image forming device body 12 and sustaining damage, and is easily loaded in and unloaded from the image forming device body 12.

When the image forming unit 96 is to be attached to the image forming device 10, the image forming unit 96 is attached in the opposite sequence of the sequence for when the image forming unit 96 is removed from the image forming device 10.

Further, the preferred embodiments of the present invention are described below.

Preferably, the rotary development unit includes development rolls that are pressed from an inner side of the rotary development unit, and a loading/unloading allowing unit allows the loading/unloading of the image forming unit in a substantially perpendicular direction with respect to the direction in which the development rolls are pressed.

Preferably, the loading/unloading allowing unit includes a guide section that guides the image forming unit in a substantially tangential direction of the rotary development unit.

Preferably, the guide section includes a first guide portion that allows the image forming unit to move in directions in which the image forming unit contacts and separates from the rotary development unit, and a second guide portion that allows the image forming unit to move in a substantially tangential direction of the rotary development unit.

Preferably, the image forming device further includes an open/close cover, wherein the image forming unit moves together with the open/close cover.

Preferably, the image forming unit further includes an image carrier cleaner that recovers toner from the image carrier.

Preferably, the image forming unit further includes an intermediate transfer member cleaner that recovers toner from the intermediate transfer member.

Preferably, the development unit is a rotary development unit.

Preferably, wherein the rotary development unit includes development rolls that are pressed from an inner side of the rotary development unit, and the loading/unloading allowing unit allows the loading/unloading of the image forming unit in a substantially perpendicular direction with respect to the direction in which the development rolls are pressed.

Preferably, the loading/unloading allowing unit includes a guide section that guides the image forming unit in a substantially tangential direction of the rotary development unit.

The entire disclosure of Japanese Patent Application No. 2003-356175 filed on Oct. 16, 2003 including specification, claims, drawings and abstract is incorporated herein by reference in its entirety.

What is claimed is:

1. An image forming device comprising:

an image carrier that carries an image;

a development unit that develops, with toners, a latent image written on the image carrier;

an intermediate transfer member to which the toner images formed on the image carrier by the development unit are primarily transferred; and a fixing unit that fixes, to paper, the toner images secondarily transferred from the intermediate transfer member, wherein the image carrier and the intermediate transfer member are unitized to configure an image forming unit, with the image forming unit being disposed in a space sandwiched between the development unit and the fixing unit where the image forming unit transects every line drawn from any point on the surface of the development unit to any point on the fixing unit, and the image forming unit further includes a loading/unloading allowing unit that allows the loading/unloading of the image forming unit.

2. An image forming device comprising:

an image carrier;

a rotary development unit that develops, with toners, a latent image written on the image carrier; and an intermediate transfer member to which the toner images formed on the image carrier by the development unit are primarily transferred, wherein the image carrier and the intermediate transfer member are unitized to configure an image forming unit, and the image forming unit includes a loading/unloading allowing unit that allows the image forming unit to be loaded and unloaded in a substantially tangential direction of the rotary development unit at a point of contact between the rotary development unit and the image forming unit.

3. The image forming device of claim 2, wherein the rotary development unit includes development rolls that are pressed from an inner side of the rotary development unit, and the loading/unloading allowing unit allows the loading/unloading of the image forming unit in a substantially perpendicular direction with respect to the direction in which the development rolls are pressed.

4. The image forming device of claim 2, wherein the loading/unloading allowing unit includes a guide section that guides the image forming unit in a substantially tangential direction of the rotary development unit.

5. The image forming device of claim 4, wherein the guide section includes a first guide portion that allows the image forming unit to move in directions in which the image forming unit contacts and separates from the rotary development unit, and a second guide portion that allows the image forming unit to move in a substantially tangential direction of the rotary development unit.

6. The image forming device of claim 2, further comprising an open/close cover, wherein the image forming unit moves together with the open/close cover.

7. The image forming device of claim 2, wherein the image forming unit further includes an image carrier cleaner that recovers toner from the image carrier.

8. The image forming device of any of claims 1 to 7, wherein the image forming unit further includes an intermediate transfer member cleaner that recovers toner from the intermediate transfer member.

9. An image forming device comprising:

an image carrier;

a development unit that develops, with toners, a latent image written on the image carrier;

an intermediate transfer member to which the toner images formed on the image carrier by the development unit are primarily transferred; and a fixing unit that fixes, to paper, the toner images secondarily transferred from the intermediate transfer member, wherein the image carrier and the intermediate transfer member are unitized to configure an image forming unit, and the image forming unit is loaded in and unloaded from the image forming device body through a space between the fixing unit and the development unit where the image forming unit transects every line drawn from any point on the surface of the development unit to any point on the fixing unit.

10. The image forming device of claim 9, wherein the development unit is a rotary development unit.

11. The image forming device of claim 10, wherein the rotary development unit includes development rolls that are pressed from an inner side of the rotary development unit, and the loading/unloading allowing unit allows the loading/unloading of the image forming unit in a substantially perpendicular direction with respect to the direction in which the development rolls are pressed.

12. The image forming device of claim 10, wherein the loading/unloading allowing unit includes a guide section that guides the image forming unit in a substantially tangential direction of the rotary development unit.

13. The image forming device of claim 12, wherein the guide section includes a first guide portion that allows the image forming unit to move in directions in which the image forming unit contacts and separates from the rotary development unit, and a second guide portion that allows the image forming unit to move in a substantially tangential direction of the rotary development unit.

14. The image forming device of claim 13, further comprising an open/close cover, wherein the image forming unit moves together with the open/close cover.

15. The image forming device of claim 14, wherein the image forming unit further includes an image carrier cleaner that recovers toner from the image carrier.

16. The image forming device of claim 15, wherein the image forming unit further includes an intermediate transfer member cleaner that recovers toner from the intermediate transfer member.

* * * * *